United States Patent [19]

Yokoyama

[11] Patent Number: 4,774,813

[45] Date of Patent: Oct. 4, 1988

[54] AIR CONDITIONER WITH DEFROSTING MODE

[75] Inventor: Hidenori Yokoyama, Tochigi, Japan

[73] Assignee: Hitachi, Ltd., Tokyo, Japan

[21] Appl. No.: 42,701

[22] Filed: Apr. 27, 1987

[30] Foreign Application Priority Data

Apr. 30, 1986 [JP] Japan ..... 61-97903

[51] Int. Cl.[4] ..... F25B 41/00

[52] U.S. Cl. ..... 62/81; 62/82; 62/156; 62/278; 62/277

[58] Field of Search ..... 62/81, 82, 278, 198, 62/151, 158, 156, 159, 196.4

[56] References Cited

U.S. PATENT DOCUMENTS 4,313,313 2/1982 Chrostowski et al. ..... 62/196.4
4,332,137 6/1982 Hayes ..... 62/151
4,565,070 1/1986 Raymond ..... 62/81

*Primary Examiner*—Henry A. Bennett
*Attorney, Agent, or Firm*—Antonelli, Terry & Wands

[57] ABSTRACT

An air conditioner having a defrosting mode of operation is disclosed, in which an outdoor heat exchanger is divided into two heat exchanger units juxtaposed in tandem with each other along the direction of air passage. In defrosting mode, a part of the refrigerant from the compressor is supplied to the upstream outdoor heat exchanger unit deposited with frost, and the rest of the high-temperature high-pressure refrigerant is supplied to the indoor heat exchanger to maintain the room temperature.

4 Claims, 4 Drawing Sheets

AIR CONDITIONER WITH DEFROSTING MODE

BACKGROUND OF THE INVENTION

The present invention relates to an air conditioner, or more in particular to an air conditioner which is capable of removing the frost attached to an outdoor heat exchanger in a heating mode.

A method of removing the frost attached to the surface of an outdoor heat exchanger during the heating operation of an air conditioner of the heat pump type is disclosed, for example, in JP-A-59-208340 for which an application was filed by Toshiba Corporation on May 13, 1983. According to this method, the refrigerant that has exchanged heat with the indoor air in an indoor heat exchanger in the heating mode is applied directly to an outdoor heat exchanger without being reduced in pressure by a capillary tube. The refrigerant that has bypassed the capillary tube is kept at a comparatively high temperature, and therefore, if the fan of the outdoor heat exchanger is stopped, is capable of heating the outdoor heat exchanger, thereby promoting the defrosting effect. In this method, which utilizes for defrosting operation what may be considered the residual heat of the refrigerant that has completed heat exchange in the indoor heat exchanger, the reduced quantity of heat of the refrigerant results in a comparatively long time required for defrosting in spite of the advantage that the defrosting operation is possible while the room is being heated.

Another example of the defrosting method is disclosed in JP-A-61-175430 for which an application was filed by Tohoku Electric Power Co., Inc. on Jan. 31, 1985. According to one method described therein, all of the high-temperature high-pressure refrigerant compressed by a compressor is supplied directly to an outdoor heat exchanger. In this method, despite the high defrosting speed, the fact that the refrigerant deprived of heat by defrosting operation of the outdoor heat exchanger is applied through an indoor heat exchanger causes a great reduction in room temperature during the defrosting operation. If the conditioner is set in heating mode after defrosting, therefore, large power and long time are required until the room temperature is increased sufficiently. According to another method disclosed in the same patent application, a high-temperature high-pressure refrigerant from a compressor is supplied to an indoor heat exchanger on one hand, and partly applied to an outdoor heat exchanger for the purpose of defrosting on the other hand. This method is liable to cause a shortage of the quantity of heat for defrosting in the case where the atmospheric temperature is low.

SUMMARY OF THE INVENTION

As explained above, the defrosting operation is required to satisfy two requirements, that is, to shorten the defrosting time and to minimize the reduction in room temperature during the defrosting process.

In order to meet these requirements, the object of the present invention is to provide an air conditioner with a defrosting mode of operation, comprising an outdoor heat exchanger including a first outdoor heat exchanger unit and a second outdoor heat exchanger unit disposed in tandem with the first outdoor heat exchanger unit along the path of air, a compressor for a high-temperature high-pressure refrigerant, a bypass pipe with a valve which supplies a part of the high-temperature high-pressure refrigerant only through the first outdoor heat exchanger unit disposed upstream and deposited with frost thereon, and an indoor heat exchanger to which the remaining refrigerant is supplied. In this configuration, a high-temperature high-pressure refrigerant is capable of being supplied to the indoor heat exchanger even during defrosting, and therefore the drop of the room temperature is prevented. At the same time, the fact that part of the high-temperature high-pressure refrigerant is supplied only to the upstream outdoor heat exchanger unit makes possible defrosting with a small quantity of refrigerant in a shorter time.

DESCRIPTION OF THE PREFERRED EMBODIMENTS

Figure 1:
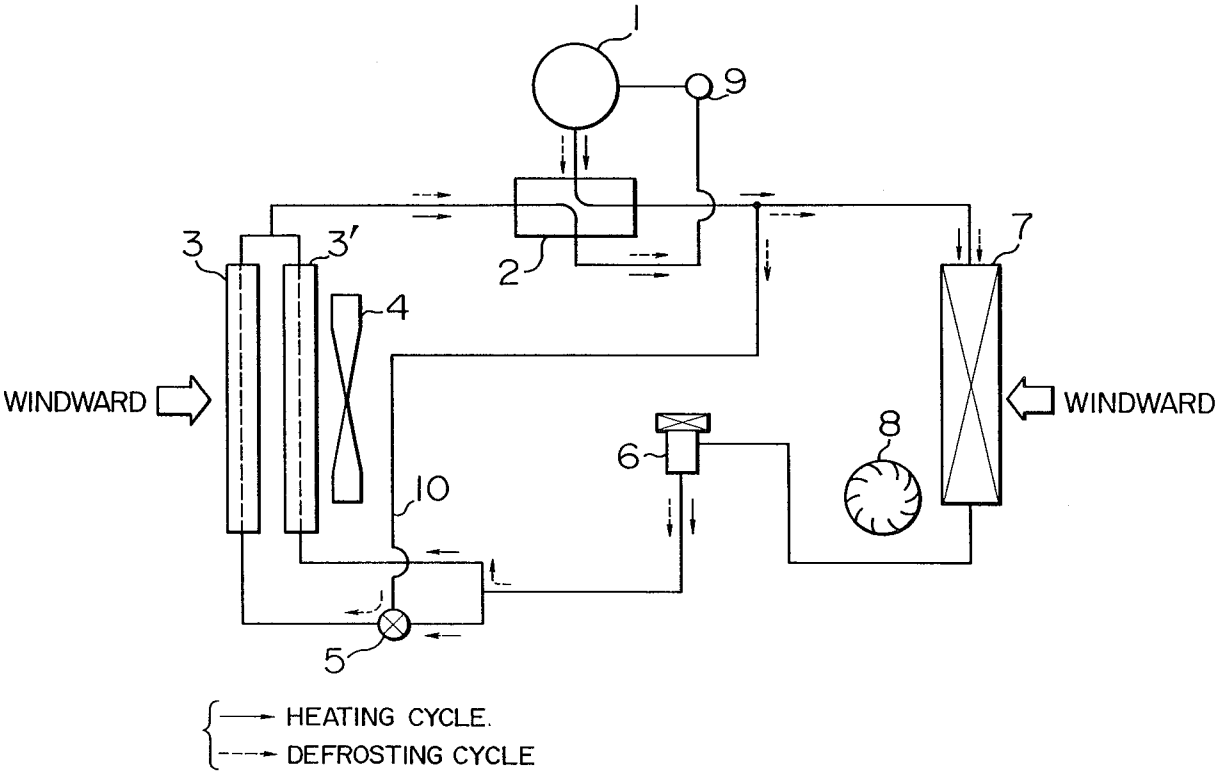
FIG. 1 is a diagram showing a refrigeration cycle according to an embodiment of the present invention.

A first embodiment of the present invention will be explained below with reference to FIGS. 1 and 2. A refrigeration cycle of an air conditioner according to the present invention is shown in FIG. 1. Reference numeral 2 designates a four-way switch valve, reference numeral 3 designates a first outdoor heat exchanger unit, and numeral 3' a second outdoor heat exchanger unit. When an outdoor fan 4 is started, atmospheric air flows in the direction indicated by solid arrows. The first outdoor heat exchanger unit 3 is disposed windward of the second outdoor heat exchanger unit 3'. Numeral 6 designates an electric expansion valve for controlling the amount of circulation of the refrigerant, and doubles as a pressure reducer. If the compressor 1 is subjected to a variable-speed operation by use of a variable-frequency inverter, the rotation speed of the compressor undergoes variations with the heating capacity, thereby causing a change in optimum refrigeration circulation. In such a case, therefore, the temperature difference before and after heat exchange by the outdoor heat exchanger is detected, and the opening of the power expansion valve 6 is regulated in accordance with the temperature difference to set the refrigerant to an optimum amount of circulation commensurate with the heating capacity. This control is realized by a combination of temperature sensors for the outdoor heat exchanger and a solenoid valve for changing the opening of the electric expansion valve 6 in response to outputs of the temperature sensors.

Numeral 5 designates a three-way switch valve for connecting the power expansion valve 6 and the first outdoor heat exchanger unit 3 in a de-energized state (heating mode) and the compressor 1 and the first outdoor heat exchanger unit 3 in a energized state (defrosting mode). By starting the indoor blower 8, heat is exchanged between indoor air and the indoor heat exchanger 7. Numeral 9 designates a suction tank for storing a liquid refrigerant, and numeral 10 a bypass tube. Thin solid arrows in the drawing represent the direction of flow of the refrigerant in heating mode, and dotted arrows that in defrosting mode.

Figure 2:
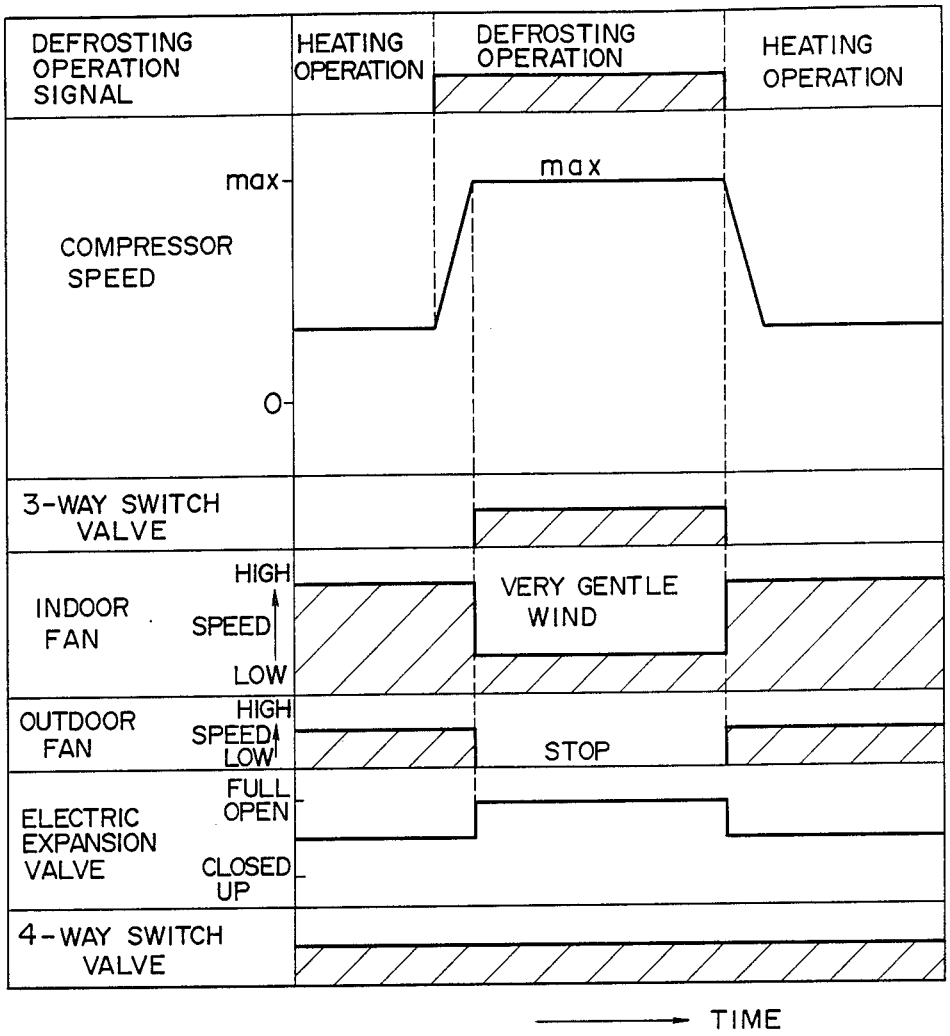
FIG. 2 is a diagram showing the defrosting mode according to the first embodiment of the present invention.

With reference to FIG. 2, the defrosting operation will be explained. When the air conditioner is operating in heating mode to control the room to a set temperature, a defrosting mode signal is applied to the compressor 1, three-way switch valve 5, indoor fan 8, outdoor fan 4 and the power expansion valve 6. This defrosting mode signal is generated, for example, when the temperature of the refrigerant outlet of the outdoor heat exchanger detected by temperature sensor drops to a predetermined sufficiently low level below the freezing point to permit a decision that frost is attached. In response to the defrosting mode signal, the compressor 1 is operated at a maximum number of r.p.m. This is in order to apply a sufficient amount of high-temperature high-pressure refrigerant to both the indoor heat exchanger 7 and the outdoor heat exchanger units 3, 3'. Further, the three-way switch valve 5, in response to the defrosting mode signal, operates in such a way that part of the high-temperature high-pressure refrigerant from the compressor 1 is imparted through the bypass tube 10 to the first outdoor heat exchanger unit 3. The defrosting operation is accomplished by the thermal energy of the high-temperature high-pressure refrigerant. In a heating mode, the three-way switch valve 5 works to establish communication between the first outdoor heat exchanger unit 3 and the power expansion valve 6. In response to the defrosting mode signal, the indoor fan 8 is set in a very gentle air mode with the air flow rate, for example, less than one half the rate at the maximum number of r.p.m., and the outdoor fan 4 stops operating. This is to prevent a drop in room temperature while at the same time securing as much heat as possible for defrosting. The electric expansion valve 6, on the other hand, in response to the defrosting mode signal, is opened full so that the refrigerant is passed to the second outdoor heat exchanger unit 3' without being reduced in pressure, thus preventing the liquid refrigerant from staying in the indoor heat exchanger 7. As the result of the high-temperature high-pressure refrigerant flowing to the first heat exchanger unit 3, the first outdoor heat exchanger unit 3 is heated thereby to melt the frost deposited on the upstream side thereof. Generally, frost is deposited on an upstream heat exchanger unit, while a downstream heat exchanger unit exposed to dry air after heat exchange is not substantially frosted. In view of the fact that the outdoor heat exchanger is divided into two units in this way, the heat capacity required for defrosting the outdoor heat exchanger is reduced to about one half, and the flow of high-temperature refrigerant that has not been subjected to heat exchange in the indoor heat exchanger 7 shortens the defrosting time.

With the melting of frost attached on the first outdoor heat exchanger 3, the defrosting operation ceases and the original heating mode of operation is restored. The defrosting mode of operation is terminated when the temperature of the refrigerant outlet of the first outdoor heat exchanger unit increases beyond a predetermined level.

The aforementioned control process is accomplished by means of storing a control program shown in FIG. 2 in a well-known microcomputer and causing the microcomputer to turn on and off the defrosting mode signal in accordance with the output signal of a temperature sensor. The microcomputer is preferably equipped with an output interface capable of converting the defrosting mode signal into signals in forms capable of controlling the compressor 1, fans 8, 4 and the three-way switch valve 5. As an alternative to such an automatic control system, the compressor 1, fans 8, 4 and the three-way switch valve 5 may be controlled manually as required while monitoring the frost deposited on the outdoor heat exchanger.

Figure 3:
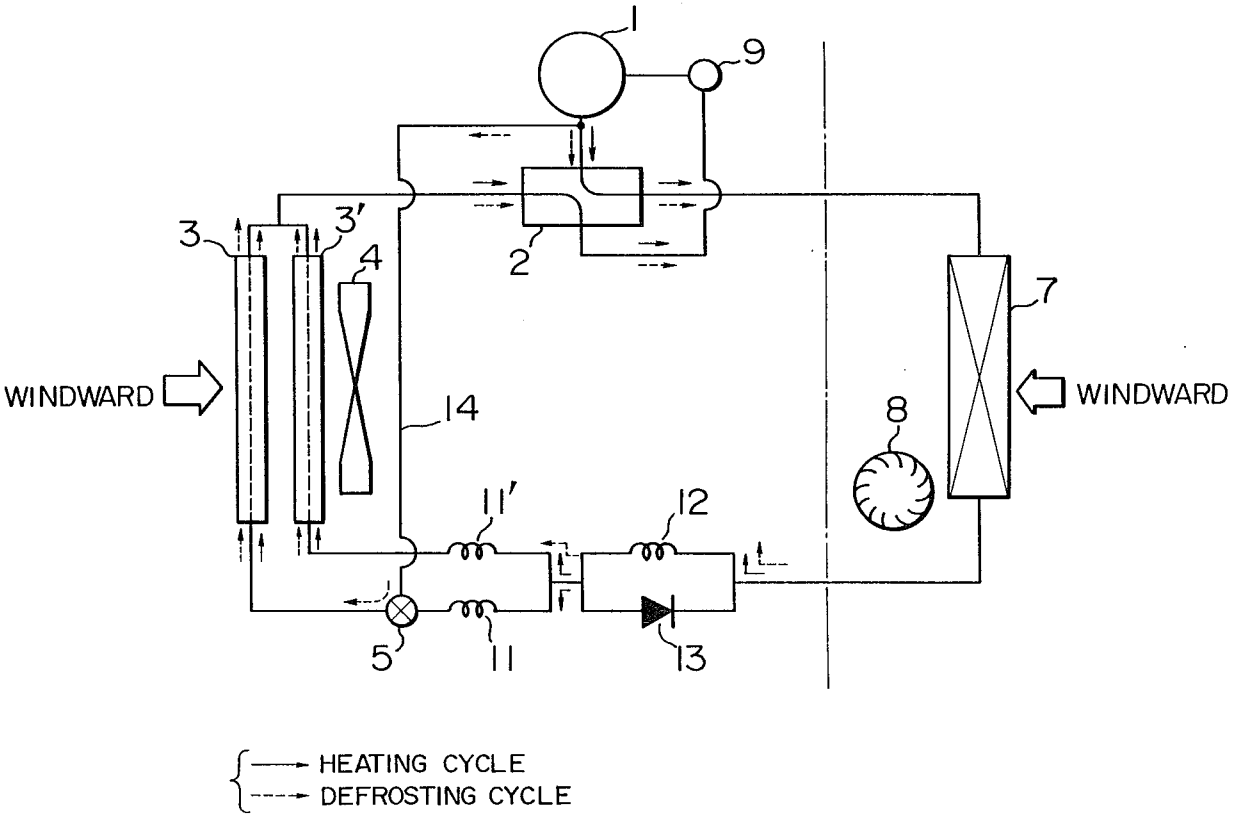
FIG. 3 shows a refrigeration cycle according to a second embodiment of the invention.
Figure 4:
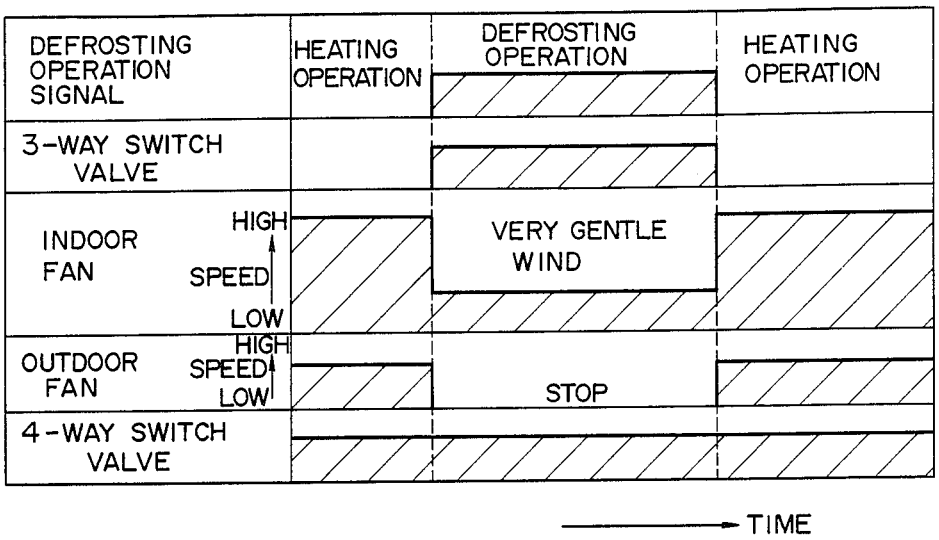
FIG. 4 is a diagram showing a defrosting mode of operation according to the second embodiment of the present invention.

A second embodiment of the present invention will be explained with reference to FIGS. 3 and 4. In FIGS. 3 and 4, the same component parts as those in FIG. 1 are designated by the same reference numerals as in FIG. 1 and therefore will not explained any more. Numerals 11, 11' designate cooling and heating capillary tubes, numeral 12 a heating capillary tube providing means for reducing pressure. Numeral 13 designates a check valve. Numeral 5 a three-way switch valve for connecting the capillary tube 11 and the first outdoor heat exchanger unit 3 when the air conditioner is de-energized, and the compressor 1 and the first outdoor heat exchanger unit 3 when the air conditioner is energized. This embodiment is different from the first embodiment in that in this embodiment a capillary tube with a fixed flow rate is used in place of the electric expansion valve providing means for reducing the refrigerant pressure. The second embodiment is suitable for an air conditioner comprising a compressor of a fixed number of r.p.m.

A defrosting timing chart for the air conditioner shown in FIG. 3 is illustrated in FIG. 4. The basic operation of the air conditioner according to the second embodiment is identical to that of the first embodiment.

In FIG. 4, assume that a defrosting mode signal is generated. The three-way switch valve 5 is energized to connect the first outdoor heat exchanger unit 3 and the refrigerant outlet of the compressor 1. As a result, the high-temperature high-pressure refrigerant that has thus far been discharged from the compressor 1 and flowed through a four-way switch valve 2 branches and partially flows into the first outdoor heat exchanger through a bypass tube 14. The flow of the high-temperature high-pressure refrigerant in the first outdoor heat exchanger 3 heats the same heat exchanger unit 3 thereby to melt the frost attached on the upstream side of the first outdoor heat exchanger unit 3. The defrosting time is thus shortened as in the first embodiment. Further, the high-temperature high-pressure refrigerant that has passed through the indoor heat exchanger 7 is reduced in pressure in the heating capillary tube 12 and the cooling-heating capillary tube 11' for evaporation in the second outdoor heat exchanger unit 3', thus reducing the amount of liquid refrigerant that returns to the compressor. It is thus possible to prevent the compressor from compressing the liquid or losing the lubricant of the compressor. In the process, the indoor fan 8 works in a very gentle air mode to prevent the room temperature from falling.

It will thus be seen from the foregoing description that according to the present embodiment, the defrosting time is shortened and the reduction in room temperature is prevented, thereby improving the comfort obtained from the air conditioner.

I claim:

1. An air conditioner comprising:

a compressor for compressing a refrigerant;

an indoor heat exchanger for causing heat exchange between the refrigerant and indoor air;

an outdoor heat exchanger for causing heat exchange between the refrigerant and the atmosphere, said outdoor heat exchanger including a first outdoor heat exchanger unit disposed upstream of and in tandem with a second outdoor heat exchanger unit downstream along the direction of air passage;

pressure reduction means for allowing the refrigerant to pass between the indoor heat exchanger and the outdoor heat exchanger, thereby reducing the pressure of the refrigerant for evaporation thereof;

means for connecting among said pressure reduction means and said first and second heat exchanger units to pass the refrigerant therethrough;

a bypass pipe with a first end thereof connected to the refrigerant outlet of the compressor so that part of the compressed refrigerant may branch; and valve means for passing the refrigerant between said connecting means and said first outdoor heat exchange unit and interrupting a connection between a second end of said bypass pipe and said first outdoor heat exchanger unit in heating and cooling cyles, and for connecting the second end of said bypass pipe and said first outdoor heat exchanger unit and passing said refrigerant from said pressure reduction means to only said outdoor heat exchanger unit in a defrost cycle.

2. An air conditioner according to claim 1, wherein said pressure reduction means is a valve of which the sectional area for allowing passage of the refrigerant is variable in accordance with the temperature difference between the refrigerant inlet and outlet of the outdoor heat exchanger unit.

3. An air conditioner according to Claim 1, wherein the pressure reduction means is a capillary tube.

4. In an air conditioner of a heat pump type having a compressor for compressing a refrigerant, an indoor heat exchanger with an associated fan, an outdoor heat exchanger having a first outdoor heat exchanger unit disposed upstream of an in tandem with a second outdoor heat exchanger unit and an associated fan, a pressure reducer operatively associated between the indoor heat exchanger and outdoor heat exchanger, a bypass pipe connected at one end to the compressor, and a valve selectively connected with another end of the bypass pipe and with the operative connection between the pressure reducer and the outdoor heat exchanger, the method of defrosting the first outdoor heat exchanger unit comprising:

sensing the temperature of the outdoor heat exchanger;

generating a defrosting mode signal when the temperature of the outdoor heat exchanger drops to a predetermined level;

applying the defrosting mode signal to the compressor valve, indoor heat exchanger associated fan, outdoor heat exchanger associated fan, and pressure reducer such that the compressor is operated at maximum rpm, the valve connects high-temperature, high-pressure refrigerant from the compressor through the bypass tube to the first outdoor heat exchanger unit, the indoor heat exchanger associated fan is set in a gentle air mode, the outdoor heat exchanger associated fan stops operating; and the pressure reducer is fully opened so that refrigerant is passed to the second outdoor heat exchanger unit without being reduced in pressure; and terminating the defrost cycle when a temperature of the first outdoor heat exchanger unit increases above the predetermined level.

* * * * *